United States Patent [19]

Caires

[11] Patent Number: 4,781,637

[45] Date of Patent: Nov. 1, 1988

[54] SWIMMING APPARATUS

[76] Inventor: Kenneth J. Caires, 681 Kaumakani St., Honolulu, Hi. 96825

[21] Appl. No.: 31,680

[22] Filed: Mar. 30, 1987

Related U.S. Application Data

[63] Continuation of Ser. No. 762,029, Aug. 2, 1985, abandoned, which is a continuation of Ser. No. 481,251, Apr. 1, 1983, abandoned.

[51] Int. Cl.[4] ..... A63B 31/10

[52] U.S. Cl. ..... 441/61; 441/64

[58] Field of Search ..... 441/55–64; 405/186

[56] References Cited

U.S. PATENT DOCUMENTS

| | | | |
|---|---|---|---|
| D. 132,377 | 5/1942 | Smith | 441/61 |
| 1,049,448 | 1/1913 | Case | 441/56 |
| 1,153,030 | 9/1915 | Claren | 2/2.1 R |
| 1,221,950 | 4/1917 | Zawadski | 441/56 |
| 1,571,462 | 2/1926 | Waldron et al. | 441/61 |
| 2,388,674 | 11/1945 | Browne | 2/2.1 R |
| 2,570,019 | 10/1951 | Wolk | 2/2.1 R |
| 2,950,487 | 8/1960 | Woods | 441/61 |
| 3,015,829 | 1/1962 | Gronkowski | 441/61 |
| 3,072,932 | 1/1963 | Ciccotelli | 441/61 |
| 3,084,355 | 4/1963 | Ciccotelli | 441/61 |
| 3,165,764 | 1/1965 | Christiansen | 441/61 |
| 3,183,529 | 5/1965 | Beuchat | 441/61 |
| 3,302,223 | 2/1967 | Ciccotelli | 441/61 |
| 3,315,286 | 4/1967 | Brion | 441/61 |
| 3,433,222 | 3/1969 | Pinto | 128/141 |
| 3,493,972 | 2/1970 | Oldham | 2/2.1 R |
| 3,521,312 | 7/1970 | Ganev | 441/61 |
| 3,665,535 | 5/1972 | Picken | 441/61 |
| 3,771,169 | 11/1973 | Edmund | 2/2.1 R |
| 3,934,290 | 1/1976 | Le Vasseur | 441/61 |
| 3,987,509 | 10/1976 | Patterman | 441/61 |
| 4,025,977 | 5/1977 | Cronin | 441/61 |
| 4,055,174 | 10/1977 | Le Vasseur | 441/61 |
| 4,342,558 | 8/1982 | Wilson | 441/61 |

FOREIGN PATENT DOCUMENTS

| | | |
|---|---|---|
| 143859 | 9/1980 | Fed. Rep. of Germany . |
| 2476012 | 8/1981 | France . |
| 676938 | 11/1964 | Italy . |
| 163582 | 11/1938 | Switzerland . |

*Primary Examiner*—Sherman D. Basinger
*Assistant Examiner*—Edwin L. Swinehart
*Attorney, Agent, or Firm*—Saidman, Sterne, Kessler & Goldstein

[57] ABSTRACT

A swimming aid, comprising a transverse fin attachable to the feet of a swimmer and formed of a resilient material so as to twist in swimming, is disclosed. In a preferred embodiment, the fin comprises a stiffening member, to control its shape while twisting. The fin is disclosed in combination with a unitary wet-suit.

16 Claims, 6 Drawing Sheets

FIG.6a
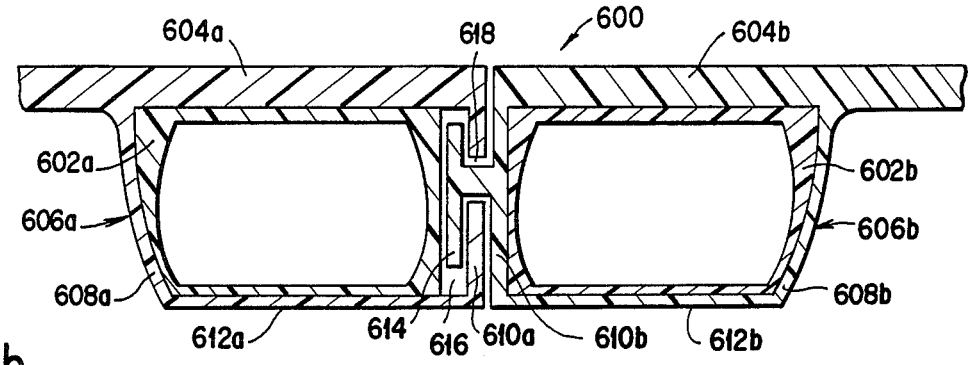
FIG.6b
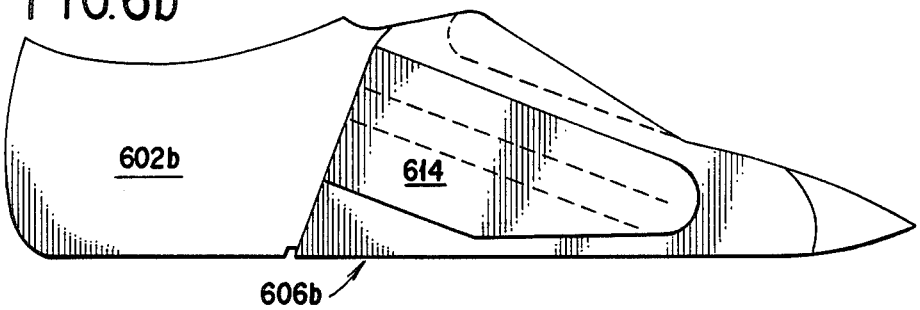
FIG.6c
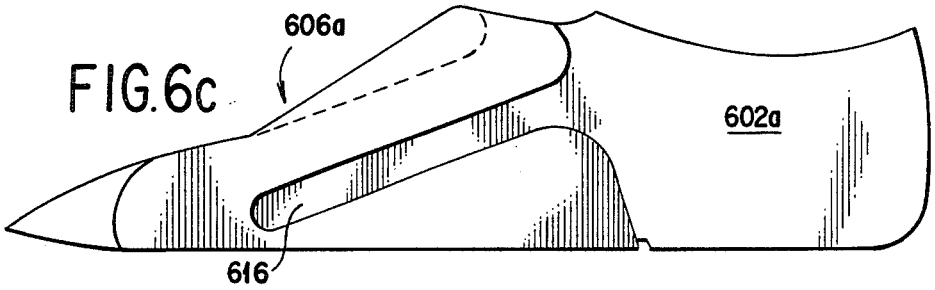
FIG.7
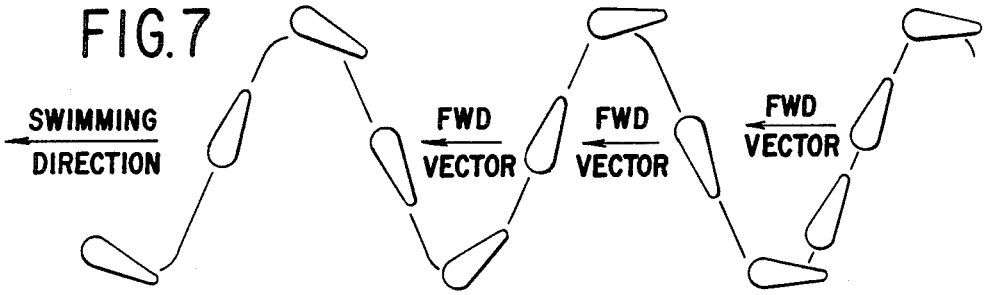
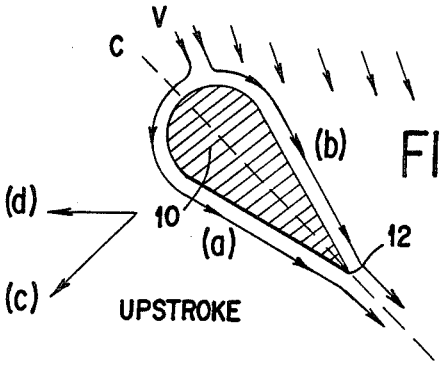
FIG.8a
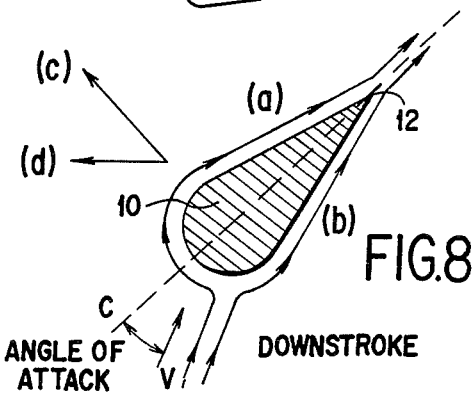
FIG.8b FIG.9
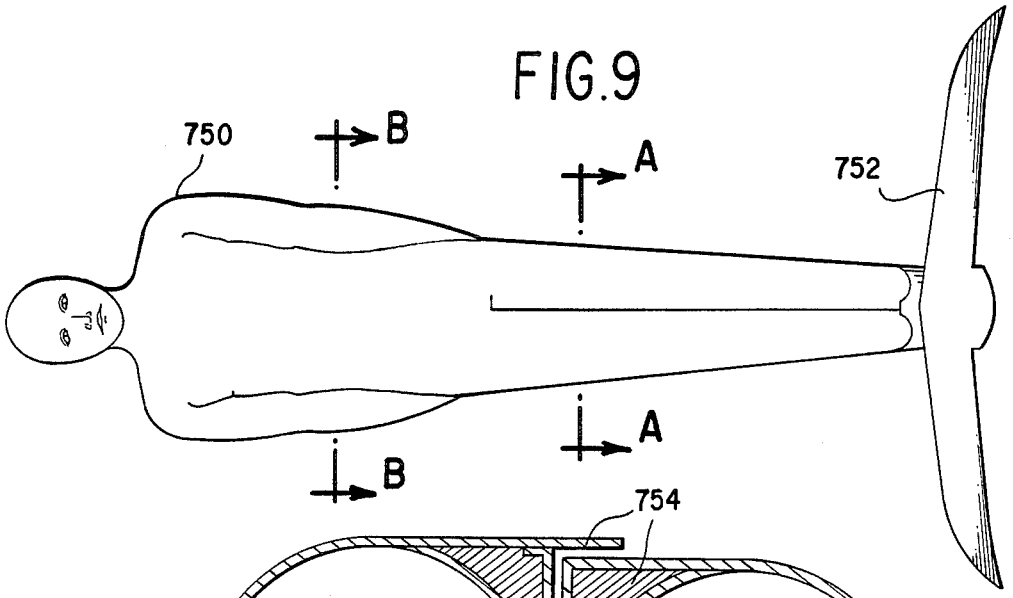
FIG.10
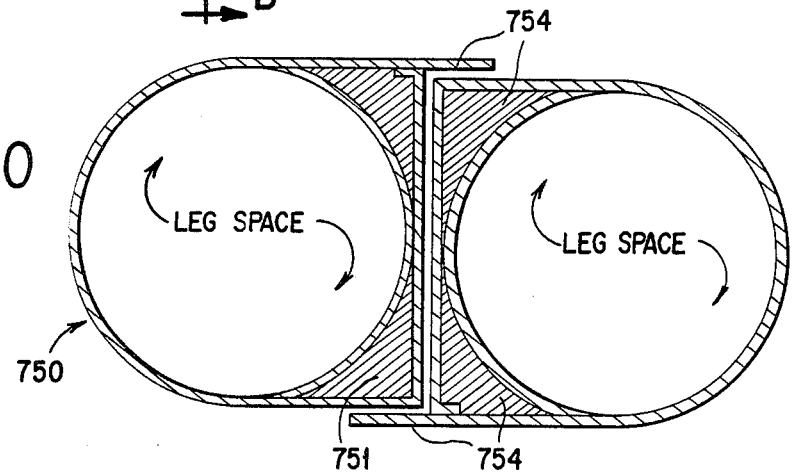
FIG.11
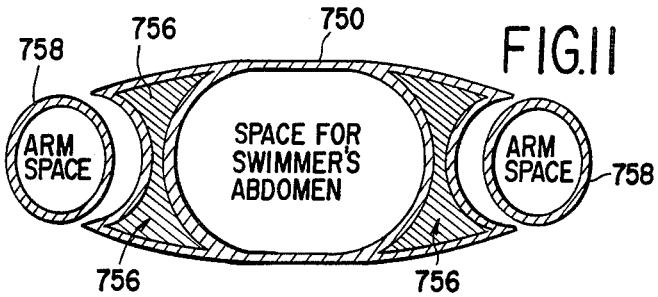
FIG.12
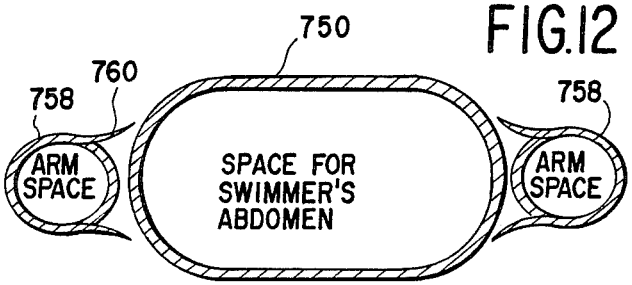
FIG.13a
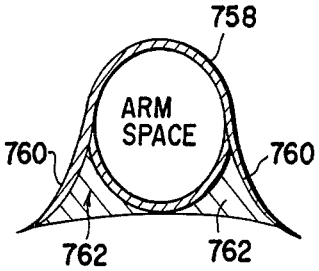
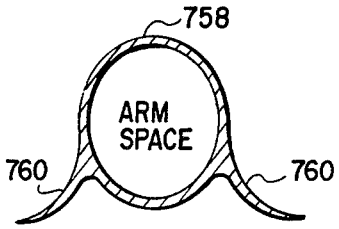
FIG.13b

SWIMMING APPARATUS

CROSS REFERENCE TO RELATED APPLICATIONS

This application is a continuation of Ser. No. 762,029, filed Aug. 2, 1985, now abandoned which is a continuation of Ser. No. 481,251, filed Apr. 1, 1983, now abandoned.

BACKGROUND OF THE INVENTION

1. Field of the Invention

The present invention relates to swimming aids, and, more particularly, is directed towards a fin which extends outwardly away from the feet of the swimmer at an angle to the swimmer's feet, and to an improved swimming garment incorporating an improved swim fin.

2. Description of the Prior Art

A wide variety of swimming aids for use on a swimmer's feet are known. Such swimming aids may comprise a single fin which receives both feet of the swimmer or a pair of fins, in which each fin receives one foot of the swimmer. A swimming aid which receives both feet of the swimmer is exemplified by U.S. Pat. Nos. 3,934,290 and 4,044,174 to LeVasseur, and is characterized by the way it substantially aligns with the plane of the swimmer's body when the feet are extended for swimming. Moreover, the substantially rectangular cross-section of the LeVasseur fin is a disadvantage because it does not enhance the swimmer's strength or speed. An integral swimming suit and swim fin is disclosed in the LeVasseur U.S. Pat. No. 4,055,174; a snorkel is built into the suit as well.

There are numerous designs for swimming aids which are used in pairs. Many, as exemplified by U.S. Pat. No. 3,302,223 to Ciccotelli, U.S. Pat. No. 3,315,286 to Brion, and U.S. Pat. No. 3,665,535 to Picken, are characterized by blades which extend from the toe of a shoe, and which reciprocate as the swimmer kicks his legs. Such a design has numerous disadvantages. Because the user kicks his legs separately, the blades which extend from each foot are likely to hit each other in passing. The pivoting of the blade does not allow the swimmer to control the angle of attack during the upstroke and the downstroke. Therefore, the design does not appreciably increase the swimmer's speed and strength.

Another swimming aid which receives both feet of the swimmer is exemplified by U.S. Pat. No. 3,987,509 to Patterman. In this design, the feet extend in opposite directions, toe to heel, a position at once uncomfortable and difficult to maintain.

Some swimming aids are characterized by a blade which is rigid in use, but fixed at an angle to the soles of the swimmer's feet. The angle results in the blade being aligned with the swimmer's lower leg. As a result, the swimmer's upstroke is extremely inefficient. Such a design is exemplified by U.S. Pat. No. 4,025,977 to Cronin.

It is known that a blade in the shape of a hydrofoil provides greater lift than a blade which is flat. Swimming aids which incorporate this concept are exemplified by U.S. Pat. No. 3,073,932 to Ciccotelli, U.S. Pat. No. 3,665,535 to Picken and U.S. Pat. No. 3,987,509 to Patterman. Ciccotelli does not appreciate the significance of the hydrofoil shape, and places it on a flexible beam past the end of the swimmer's toe. The flexibility of the beam prohibits the swimmer from controlling the angle of attack, and the size and location of the hydrofoil further detract from its efficiency. The hydrofoil used by Picken also is subject to reciprocating motion, and is beyond the end of the swimmer's toe. Thus, although Picken recognizes the advantage of using a hydrofoil, its use is not optimized. Patterman places the sharp edge of the hydrofoil in the direction of the swimmer's head. In order for the hydrofoil to create the desired lift, the sharp edge of the hydrofoil must point away from the swimmer's head. Patterman therefore not only does not appreciate the hydrofoil concept, but also makes improper use of it.

Other United States patents which relate generally to swimming aids include U.S. Pat. Nos. Des. 132,377; U.S. Pat. Nos. 2,950,487; 3,084,355; and 3,165,764. However, none of the structures described in these patents solve the problems noted above.

Italian Pat. No. 676,938 to Alinari shows a swim fin in which an hydrofoil shape is provided traversely to the direction of the motion of the swimmer. The hydrofoil is of an aspect ratio of approximately 3 to 1, and is spaced from the toe of the swimmer by a beam member. While use of an hydrofoil in the swim fin is very desirable, as will be discussed in detail below in connection with Applicant's invention, spacing the hydrofoil away from the toe of the swimmer is very undesirable as it obliges the user to exert very high torque to move the hydrofoil through the water. Moreover, the construction shown in the Alinari patent is not optimal with respect to the shape of the hydrofoil and its relationship to the direction of movement of the swimmer through the water, as will also be explained in detail below.

Ganev U.S. Pat. No. 3,521,312 shows a combined swim shoe and fin, in which the fin is removably attached to the shoe. The fin is of low aspect ratio and does not include an effective hydrofoil shape.

SUMMARY OF THE INVENTION

In the swimming apparatus of the present invention, a pocket is provided for receiving the swimmer's feet in spaced apart, side-by-side relation, and a fin is provided extending outwardly from the pocket and away from the swimmer's feet, at an angle to a plane defined by the soles of the swimmer's feet. This angle allows approximately the same angle of attack during the downstroke and the upstroke of the swimmer's kick. The angle of the fin to the swimmer's body is controlled by the angular movement of the swimmer's hips, knees, and ankles.

In accordance with other aspects of the present invention the fin may be placed with relation to the swimmer's feet so that the resultant lift vector of the fin is close to the pivot point of the swimmer's ankles.

In accordance with more specific aspects of the present invention, the aspect ratio of the fin is preferably at least approximately 3 and may be as high as approximately 12. The surface of the fin may be rectangular in shape, tapered, or round. In accordance with another aspect of the present invention, the pocket which receives the swimmer's feet comprises left and right chambers for receiving the lft and right feet of the swimmer and a wall separating the chambers. The fin preferably is positioned on the top of the pocket above the insteps of the swimmer's feet.

In accordance with another aspect of the present invention, there is provided a swimming aid which is separable into a left half and a right half. The left half comprises a left half foot pocket for receiving the left foot of the swimmer, and a left half fin positioned on the left half foot pocket extending outwardly away from the left half foot pocket at an angle to a plane defined by the sole of the swimmer's left foot. The right half comprises a right half foot pocket for receiving the right foot of the swimmer, and a right half fin extending outwardly away from the right half foot pocket at an angle to the plane defined by the sole of the swimmer's right foot. The left half foot pocket and the right half foot pocket are joined in side-by-side relation by an interlock mechanism. More specifically, the interlock mechanism may comprise a raised shoulder position on one of the half foot pockets and a mating slot positioned in the adjoining side of the other half foot pocket.

In accordance with an additional aspect of the invention, there is provided a swim fin formed to be attached to a unitary swimming suit or "wet-suit" in which the shape and relative location of the swim fin is optimized with respect to the swimmer such that unprecedented advances in swimming efficiency and comfort are realized. An improved wet-suit design is also shown in which streamlining is provided around the swimmer's arms and legs, so as to further render his swimming efforts more efficient.

In a particularly preferred embodiment of the present invention, the cross-sectional shape of the fin is varied on the upstroke and downstroke, responsive to the pressure of water thereon. The fin may be of a resilient material, twisting about a stiffening tranverse member, or may comprise a skin over linkage members which control the variation in its shape.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 6*a* is a cross-sectional view illustrating another alternate embodiment of the swimming aid of the present invention, in which the left half and the right half of the swimming aid are separable;

FIG. 6*b* is a side view, partially cut away, of the left half of the embodiment of FIG. 6*a;*

FIG. 6*c* is a side view of the right half of the embodiment of FIG. 6*a;*

FIG. 7 is a schematic, cross-sectional view of the path of a swimming aid of the present invention through the water as the swimmer kicks;

FIG. 8*a* is a schematic, cross-sectional view of water flow around, and lift vectors affecting, the swimming aid of the present invention during the upstroke;

FIG. 8*b* is a schematic, cross-sectional view of water flow around, and the lift vectors affecting, the swimming aid of the present invention during the downstroke;

FIG. 9 shows an improved wet-suit incorporating the hydrofoil cross-section swim fin of the invention;

FIG. 10 shows a cross-section along lines A—A of FIG. 9;

FIG. 11 shows a first alternate cross-section taken along the line B—B of FIG. 9;

FIG. 12 shows second alternate cross-section taken along the line B—B of FIG. 9;

FIGS. 13*a* and 13*b* show two ways in which streamlining may be provided for the arms of wet-suits according to the invention;

DETAILED DESCRIPTION OF THE PREFERRED EMBODIMENT

Figure 1A:
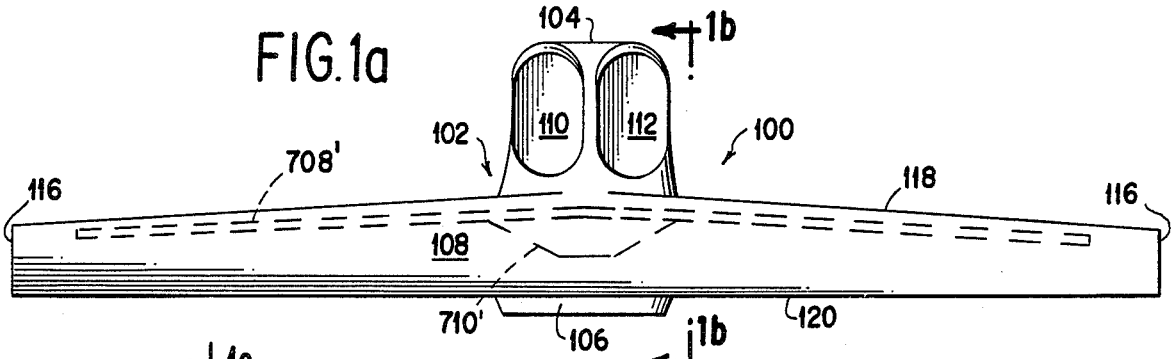
FIG. 1*a* is a plan view of a preferred embodiment of the swimming aid of the present invention.

Until now, the principles of fluid dynamics have not been rigorously applied in the design of swimming aids. The principles of fluid dynamics can be used to design a swimming aid having increased lift and reduced drag. In particular, Bernoulli's principle, which states that the pressure exerted on a body by fluid flowing past the body perpendicular to the direction of the flow is reduced as its velocity is increased, is applied to the sport of swimming by the present invention.

Referring now to FIGS. 8*a* and 8*b*, a cross-section 10 of a hydrofoil moving through water is illustrated. As used in the present application, the term "hydrofoil" is not used in its usual sense of a wing-like structure attached to the hull of a watercraft upon which the watercraft skims at high speeds, but is here used to mean a body whose surface reacts to the water through which it moves. For a hydrofoil, water flow (a) over the top surface of the hydrofoil takes a longer path than water flow (b) under the bottom surface of the hydrofoil. The water flow over the top surface of the hydrofoil must therefore travel faster than the water flow under the bottom surface of the hydrofoil to reach the trailing edge 12 of the hydrofoil at the same time as the water flow under the bottom surface of the hydrofoil. According to Bernoulli's principle, the pressure on the top surface of the hydrofoil is lower than on the bottom surface of the hydrofoil. This pressure differential creates a lifting force.

The hydrofoil design and the lift it creates can be applied to a swimming aid. In a swimming aid according to my invention, the fin portion is the hydrofoil. The hydrofoil cross-section 10 is illustrative of the cross-section of the fin portion of a swimming aid according to the invention during the upstroke (FIG. 8*a*) and the downstroke (FIG. 8*b*) of the swimmer. The lift of the fin is affected by the aspect ratio, the cross-section, the angle of attack, and the speed of water flow, and can be maximized by adjusting the aspect ratio, the cross-section, and the angle of attack in accordance with the speed of the swimmer. Referring again to FIGS. 8*a* and 8*b*, aspect ratio is used in its usual sense to mean the ratio of the width or span of the hydrofoil to mean length or chord line C of the hydrofoil. Angle of attack is used in its usual sense to mean the inclination between the chord line C and the relative water velocity V.

At the relatively slow speed of the human swimmer, a relatively large fin area is best. Within that constraint, however, the purpose of the fin, whether for leisurely cruising or rapid travel, may dictate more specifically the dimensions of the fin. Size is limited by two factors. First, if the fin is too large, it will create excessive drag, and the swimmer will not be able to move through the water fast enough to match the lift with his power. Too small a fin will waste the swimmer's power. Second, the center section of the surface or working area of the fin is much less efficient than the outer section due to the turbulence created by the water flow over the body and legs of the swimmer. Positioning a relatively large portion of the fin to the sides of the swimmer's feet in smooth flowing water, rather than in line with the swimmer's body, increases the efficiency of the fin and is highly advantageous. Thus, the bulk of the fin's area is best accommodated at the sides of the swimmer's feet. Taking into account absolute size limitations based on the size and speed of the human swimmer, the aspect ratio of the fin should be no greater than approximately 12, but in no event should it be less than approximately 3. Making the aspect ratio less than approximately 3, that is, increasing the area by increasing the length of the fin in proportion to its width as is commonly done, makes the fin much more difficult to operate because substantially its entire length is positioned in the turbulent water flow behind a swimmer's body and legs.

It is desirable to use a hydrofoil which is symmetric about its chord line so that lift can be created over the bottom surface as well as the top surface by changing the angle of attack. A teardrop cross-section is preferable because it minimizes drag while creating lift. A fin which is a hydrofoil thus preferably has a teardrop cross-section. To accommodate the relatively slow speed of the human swimmer, the thickness of the fin cross-section should be relatively large. By shaping the fin cross-section to create the highest water speed near the leading edge, the resultant lift vector will be situated near the leading edge of the fin and pointed more in the forward direction due to the curvature of the leading edge. This results in a larger forward vector, and greater forward speed.

Angle of attack is critical because when it is too large, it causes too much drag, and at the extreme, will cause a stall which destroys the left. Too small an angle of attack, on the other hand, creates too little lift. The difficulty in designing a swimming aid is that angle of attack is maintained by the swimmer, and changes throughout the course of the swimmer's upstroke and downstroke. Consequently, the fin must be designed to allow the swimmer easily to sense and maintain the best angle of attack during any part of the stroke at any speed. Moreover, a wide range of angles of attack must be available to the swimmer. The primary means for providing a sufficiently wide range of angles of attack is to situate the fin at an angle to the soles of the swimmer's feet. The best angle for the fin is in the range of approximately 20 to 30 degrees, and preferably about 26 degrees.

The speed of the water flow over the surface of the fin can be affected by the swimmer's stroke or kick. A quick, flicking motion as in a dolphin kick (FIG. 7) induces a faster water flow over the surface of the fin. Locating the fin close to the ankles above the instep and to the sides of the swimmer's feet rather than beyond the toes allows the swimmer more easily to use this quick flicking motion to induce the higher speed water flow. This is because the short lever arm from the ankle to the resultant lift vector of the fin gives the swimmer a very favorable mechanical advantage rotating the fin about its longitudinal axis, despite the heavy loads applied to the fin.

Figure 3:
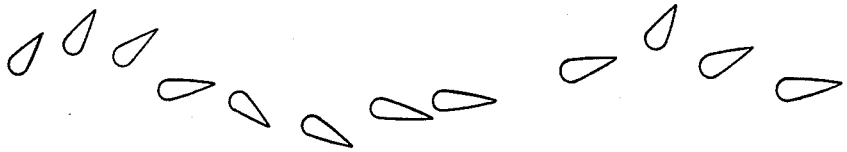
FIG. 3 shows the principle of operation of the improved swim fin according to the invention.
Figure 4:
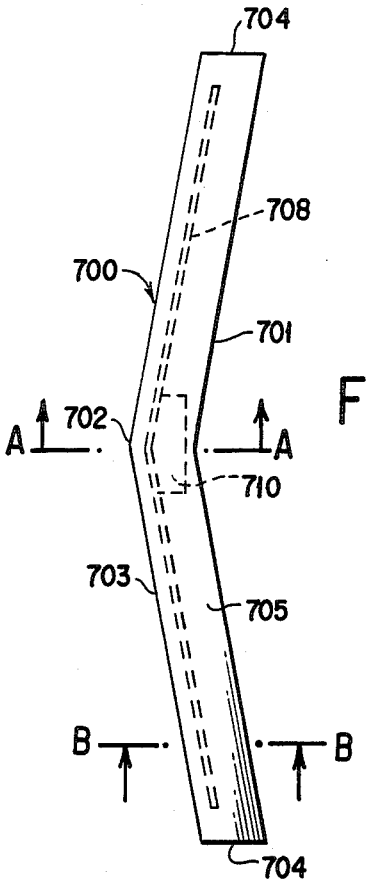
FIG. 4 shows a plan view of the improved swim fin according to the invention.
Figure 5:
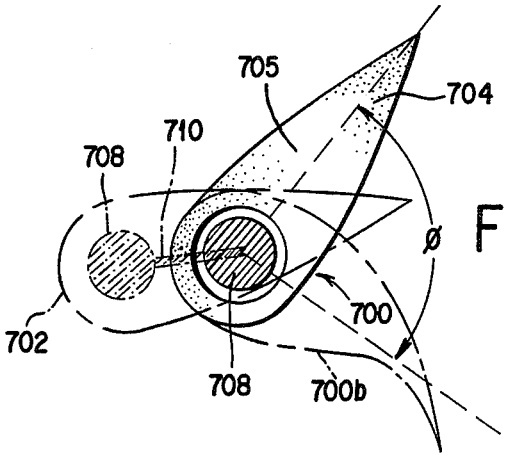
FIG. 5 shows the principle of operation of the fin of FIG. 4.

FIGS. 3–5 explain additional aspects of the operation of the improved swim fin according to the invention.

As mentioned above, Bernoulli's principle, according to which a fluid undergoing laminar flow (flow in which water or other fluid passes in layers over the surface being traversed, such that water having to traverse a longer distance is accelerated) over a hydrofoil or other wing-like shape creates lift, is exploited by the present invention in its creation of a swim fin which is teardrop-shaped in cross-section. As illustrated in FIG. 3, which shows sequential positions of the fin, the trailing edge of the fin travels a greater distance through the water than does the leading edge. This creates lift, urging the swimmer forward. Bernoulli's principle is also utilized by a second aspect of the present invention, according to which the two ends of the swim fin are swept back, such that the tips of the swim fin are further behind, e.g., the ankles of the swimmer, than is the center portions. Accordingly, water flow is accelerated at the ends with respect to the center, because the tips are swept through a greater amount of water than is the center portion. This creates more lift at the ends of the hydrofoil than if it were straight, i.e., than if its edges were perpendicular to the direction of travel of the swimmer. This, in turn, causes the blade to twist which creates additional lift, increasing the velocity of the swimmer through the water for a given muscular effort. For this reason, the swept back swim fin is the preferred embodiment of the invention. The extra angle of attack provided by the twist caused by the sweeping back of the fin portions is particularly useful in making the teardrop cross-sectional shape work effectively, as the swimmer's ankles do not provide enough angular movement.

FIG. 4 shows a plan view of a preferred embodiment of a swim fin blade 700 according to the invention. A blade incorporating the principles of this invention comprises a relatively flexible portion 705 which may be formed of a flexible plastic, such as a polyurethane or the like, although it is envisioned that to ensure assumption of the correct cross-sectional shape upon movement of the fin of the invention through the water may require use of exotic high strength, low mass materials such as Kevlar (trademark DuPont Corp.) or carbon fiber. The tips 704 of the blade 700 are swept back from a central portion 702 to provide the shape shown. Its cross-sectional area is that of a teardrop, having a rounded leading edge 703 and a substantially thinner—indeed even sharp-edged—trailing edge 701. Within the flexible portion 705 is disposed a rigid rod 708 which may be formed of a metallic material or of less flexible plastic, such as glass fiber reinforced plastic material or the like. The rod 708 provides stiffness without excessive weight to the swim fin such that it is constrained to twist only about the rod 708 under the influence of water pressure exerted on the blade upon being swept through the water by a swimmer. Preferably, a plate 710 is disposed at the center of the rod. Plate 710 will typically be formed integrally with the rod 708; both may be formed of a plastic material, or plate 710 may be welded to rod 708 if metallic rod and plate materials are used.

Figure 4A:
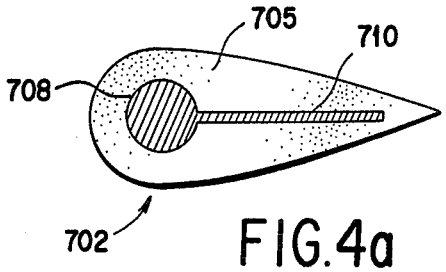
FIG. 4*a* shows a cross-section on the line A—A of FIG. 4.

FIG. 4*a* is a cross-section of the swim fin blade of FIG. 4 taken along the line A—A thereof. As shown, the center section 702 of the resilient portion 705 encloses a rigid rod 708 which has a planar member 710 designed to stabilize the center of the swim fin blade according to the invention.

Figure 4B:
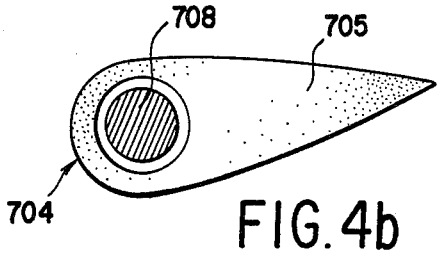
FIG. 4*b* shows a cross-section on the line B—B of FIG. 4.

FIG. 4*b* is a cross-section taken along line B—B of FIG. 4, i.e., toward one end 704 of the fin blade and shows the resilient outer portion of the swim fin 705 and the rigid rod 708. A space is shown therebetween, to indicate relatively free rotation of the flexible portion with respect to the rod 708. It will be understood, of course, that the main goal to be achieved by the structure shown is that the tip portion is to be permitted to rotate substantially flexibly through an angle of at least about 90 degrees with respect to the rod 708, so as to obtain the desired angle of attack on both the upward and downward strokes.

FIG. 5, taken at a cross-section B—B of FIG. 4, shows the configuration assumed by the blade during a downstroke of the swimmer's leg. Thus, the central portion 702 (shown in dotted lines) of the swim fin blade is generally horizontal, whereas the tip portion 704, at section B—B, has a substantially steeper angle of atack due to the twist of the relatively flexible portion 705 about the rod 708 as shown. The twisting may further cause the cross-sectional shape to become asymmetrical, as shown by the dotted-line outline 700*b*, which shows a possible outline of the cross-section along a line comparable to B—B of FIG. 4 of the fin during an upstroke.

It will be appreciated by those skilled in the art that the improvements in lift provided by the increased angle of attack shown in FIG. 5, due to the swimmer's sweeping his foot downwardly through the water, will be to some extent counterbalanced by the frictional force or drag of the water caused by its flow over the blade, left to right in the drawing of FIG. 5. Clearly, the actual angle achieved between the cross-section B—B and the central portion of the blade will be a relatively complex function of such things as the friction of the water over the blade, the speed of the swimmer's kick relative to his forward speed in the water at any given moment, the resiliency of the plastic material used to form the flexible portion 705, the friction between the rod 708 and the flexible portion 705, and possibly other variables. However, the present inventor has found that a structure substantially as shown, using the materials mentioned above, does provide a substantially improved swimming velocity for a given kicking effort, and it is believed that the shape shown in FIG. 5 is approximated by the blade. Indeed, the present inventor's preliminary findings, derived primarily from model studies, appear to indicate that the relative twist of the blade, i.e. the deviation of the tips 704 from their maximum upward angle of attack to their downwardly depressed angle of attack, as shown at in FIG. 5, is desirably at least about 90 degrees, and may ultimately be found to approach 180 degrees. This figure is comparable to that observed by watching powerfully-swimming fish such as sharks.

Furthermore, of course, if the swimmer uses his hands to help propel himself while swimming, the additional forward velocity provided thereby will increase the lift provided by the fin and hence its efficiency for a given angle of attack.

The swim fin blade of the invention just described thus involves use of a very high aspect ratio fin of teardrop cross-sectional shape. This arrangement gives a high lift-to-drag ratio at typical swimming speeds, and keeps most of the hydrofoil out of the turbulence caused by the swimmer's passage. Furthermore, affixing the blade close to the swimmer's ankles transmits the lift to the swimmer without undue stress.

Figure 1B:
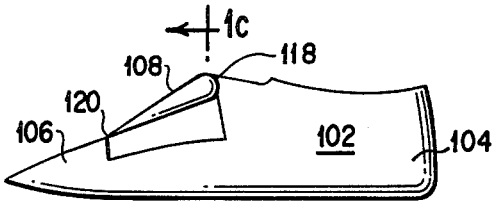
FIG. 1*b* is a side view taken along the line 1*b*—1*b* of FIG. 1*a;*
Figure 1C:
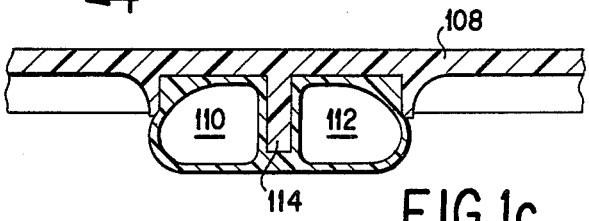
FIG. 1*c* is a side view taken along the line 1*c*—1*c* of FIG. 1*b;*
Figure 2A:
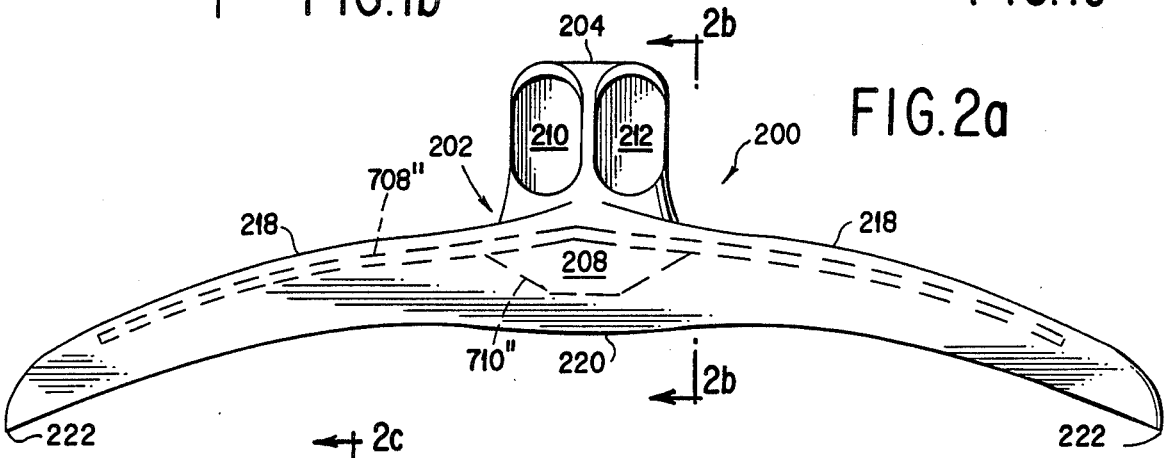
FIG. 2*a* is a plan view of an alternate embodiment of the swimming aid of the present invention.
Figure 2B:
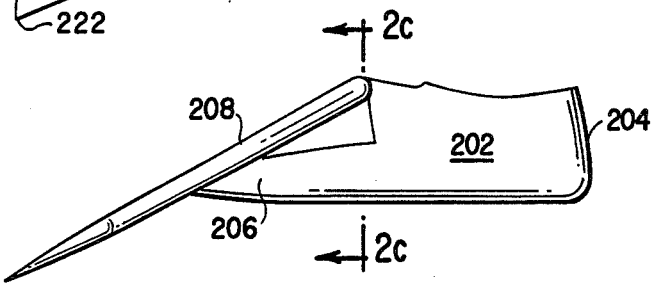
FIG. 2 is a side view taken along the line 2*b*—2*b* of FIG. 2*a;*
FIG. 2*c* is a cross-sectional view taken along the line 2*c*—2*c* of FIG. 2*b;*
Figure 2C:
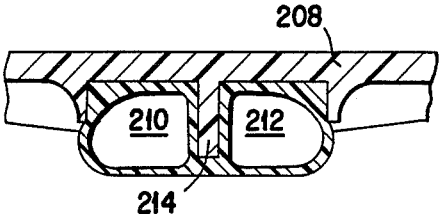

FIGS. 1*a* through 1*c* illustrate a preferred embodiment of a swimming aid incorporating the blade of the present invention, which is indicated generally by reference numeral 100.

The swimming aid 100 comprises a foot pocket 102 having a heel end 104 and a toe end 106 for securely receiving the swimmer's feet in spaced-apart, side-by-side relation and a fin 108 extending outwardly away from the foot pocket 102 at an angle to a plane defined by the soles of the swimmer's feet. The best angle is in the range of approximately 20 to 30 degrees, and preferably about 26 degrees. Foot pocket 102 is divided into a right chamber 110 and a left chamber 112. A wall 114 separates right chamber 110 from left chamber 112. The fin 108 is substantially rectangular in shape, side edges 116 being at approximately right angles to leading edge 118 and trailing edge 120. Fin 108 is a hydrofoil. In cross-section, it has a teardrop shape, the rounded portion of the teardrop corresponding to leading edge 118. Leading edge 118 of fin 108 faces towards the head of the swimmer, in the direction of travel. Fin 108 has a rod 708' and plate 710' incorporated therein to provide the stiffening necessary to achieve the flexible action described above with respect to FIGS. 3–5.

Swimming aid 100 is designed to permit the swimmer to achieve maximum speed, and in accordance with the principles of fluid dynamics, fin 108 has a very high aspect ratio of at least approximately 10. For best results, the size of fin 108 must be matched to the size and strength of the swimmer. For example, for a swimmer approximately 5 feet 10 inches tall and weighing approximately 175 pounds, a fin having a length of approximately 42 inches, an average width of approximately 3½ inches, and a maximum thickness of approximately ⅝ inch would provide a very good performance. The aspect ratio of fin 108 with these dimensions would be approximately 12. Because of the extremely high aspect ratio, fin 108 is subject to bending stresses. In the preferred embodiment the fin 108 twists as discussed above. However, the applicant has found that non-twisting fins are also useful; to the extent the claims of this application do not limit the fin blade of the invention to embodiments which twist, non-twisting fins are within the scope of the invention. In such cases, of course, fin 108 must therefore be made of a stiff, strong material to maintain the straight constant shape necessary to keep the lift vectors pointed in a constant direction at all times.

Referring now to FIGS. *2a–2c*, there is illustrated an additional preferred embodiment of a swimming aid in accordance with the present invention, indicated generally by reference numeral 200. Except for the configuration of fin 208, swimming aid 200 is similar in structure to swimming aid 100. The swimming aid 200 comprises a foot pocket 202 having a heel end 204 and a toe end 206 for securely receiving the swimmer's feet in spaced-apart, side-by-side relation and a fin 208 extending outwardly away from the foot pocket 202 at an angle to a plane defined by the soles of the swimmer's feet. The best angle is in the range of approximately 20 to 30 degrees, and preferably about 26 degrees. Foot pocket 202 is divided into a right chamber 210 and a left chamber 212. A wall 214 separates right chamber 210 from left chamber 212. The fin 208 has a swept-back, tapered shape, leading edges 218 tapering to intersect the trailing edge 220. Fin 208 is a hydrofoil, and has a teardrop-shaped cross-section. The rounded portion of the teardrop corresponds to the leading edges 218. Leading edges 218 of fin 208 face towards the head of the swimmer, in the direction of travel. Fin 208 has a rod 708″ and plate 710″ incorporated therein to provide the stiffening necessary to achieve the flexible action described above with respect to FIGS. 3–5.

The configuration of fin 208 of swimming aid 200 results in better acceleration than the configuration of fin 108 of swimming aid 100. Fin 208 is stiff in the lengthwise direction thanks to rod 708″, but is flexible across its width (i.e., in twist about rod 708″). The swept-back shape induces a twist in the fin 208 starting at the tips 122 when subject to great force. The twist reduces the angle of attack at tips 222 and aims the lift vector in a more forward direction than the swimmer can achieve with his spine, hips, knees, and ankles, resulting in quick acceleration. The twisting reduces efficiency slightly at cruising speeds by reducing the angle of attack near the tips 222 of fin 208. However, much less twisting is induced at cruising speeds because the swimmer is applying much less power to the swimming aid 200 than during acceleration, so that swimming aid 200 is still very efficient at cruising speeds.

Referring now to FIGS. *6a–6c*, there is illustrated a further preferred embodiment of a swimming aid in accordance with the present invention, indicated generally by reference numeral 600. The swimming aid 600 is separable into a right half and a left half, and comprises right and left half foot pockets **602*a* and 602*b* and right and left fins 604*a* and 604*b*. Integral with and extending downward from right fin 604*a* is a right receiving structure 606*a* for receiving right foot pocket 602*a*. Right receiving structure 606*a* comprises an outer wall 608*a*, an inner wall 610*a*, and a bottom wall 612*a*. Integral with and extending downward from left fin 604*b* is a left receiving structure 606*b* for receiving left foot pocket 602*b*. Left receiving structure 606*b* comprises an outer wall 608*b*, an inner wall 610*b*, and a bottom wall 614. Inner wall 610*b* of structure 606*b* includes a raised shoulder 614. Inner wall 610*a* of structure 606*a* extends beyond right foot pocket 602*a* and includes an aperture 616 so as to form a mating slot for receiving raised shoulder 614 of structure 606*b*. By sliding shoulder 614 in and out of mating slot 618, the swimmer can unite and separate the left and right halves of swimming aid 600, according to whether the swimmer desires to swim, or to wade or otherwise walk about. Swimming aid 600 is not designed for swimming when disconnected. The features of swimming aid 600 may be incorporated into any relatively high aspect ratio swimming aid in accordance with the present invention, for example, swimming aid 100 or swimming aid 200. Right and left fins 604*a* and 604*b* right and left receiving structures 606*a* and 606*b* are preferably made of a stiff, strong plastic such as nylon or a high molecular weight plastic. Right and left foot pockets 602*a* and 602*b* are preferably made of a soft, stretchy plastic and are inserted into and welded to right and left fins 604*a* and 604*b* and right and left receiving structures 606*a* and 606*b*. It should be understood that the features of right and left receiving structures 606*a* and 606*b* may be interchanged, so that raised shoulder 614 extends from the right receiving structure 606*a*, and the mating slot is formed in left receiving structure 606*b***.

FIG. 9 shows an improved wet-suit 750 according to another aspect of the invention, comprising an outer skin of a relatively tough water-impermeable material having a permeable foam therewithin as is generally conventional. Affixed to the wet-suit portion 750 is a tail fin portion 752 according to any of the preferred embodiments of the invention.

FIG. 10 shows a cross-section of a wet-suit taken along the line A—A of FIG. 9 and shows how additional fairing members 754 may be provided for the swimmer's legs. These provide further streamlining and hence better motion through the water. The interstitial spaces between the fairings 754 and the legs of the swimmer can be filled with a flexible rubber foam, or can be used to store various useful items carried by swimmers, e.g. watches, knives, compasses, etc. As shown, the leg portions are desirably separate to permit walking, unlike, for example, the devices shown in the LeVasseur patent referred to above. Fairing 754 permits this without undue water resistance.

FIG. 11 shows a cross-section of a first embodiment of the improved wet-suit of the invention taken along the line B—B of FIG. 9. Here, additional fairing members 756 are provided within which the arm portions 758 of the wet-suit may fit. Again, this is designed to provide additional streamlining and hence more efficient swimming. Again, the space between the fairings can be filled with rubber or plastic foam and/or various useful items as discussed above, as at 751, where a void space for insertion of, e.g., a compass is shown.

FIG. 12 shows a second alternative embodiment of cross-section B—B of FIG. 9. In this case, the fairing members 760 are attached to the swimmer's arms, instead of to the body portion 750 of the wet-suit. FIG. 13 shows two alternative ways in which these can be made. FIG. **13*a* shows a system in which the fairing member 760 has foam or cellular plastic material 762 inserted behind it to support the flap-like fairing member 760 and provide a good fit to the swimmer's body. Another possibility would be to provide a one-piece rubber extrusion or the like as shown in FIG. 13*b* for the arms, in which case the fairing member 760 would be integral with the tubular arm portion 758**.

Fairings could also be applied to other portions of the suit as well, in particular, to fair in conventional SCUBA or other underwater breathing equipment. Ultimately, the streamlining provided to a fullyequipped swimmer should make him as hydrodynamically "clean" as a shark.

In a preferred embodiment, the foam used in providing the proper shape to the fairing members shown in FIGS. 10–13 is injected while the swimmer or a suitable mannequin is wearing the suit, to ensure the best possible fit. The foam should be flexible but adhere to the swimming suit. The foam may be closed-or or open-celled, depending on the use of the suit, to provide positive or neutral buoyancy.

Figure 14A:
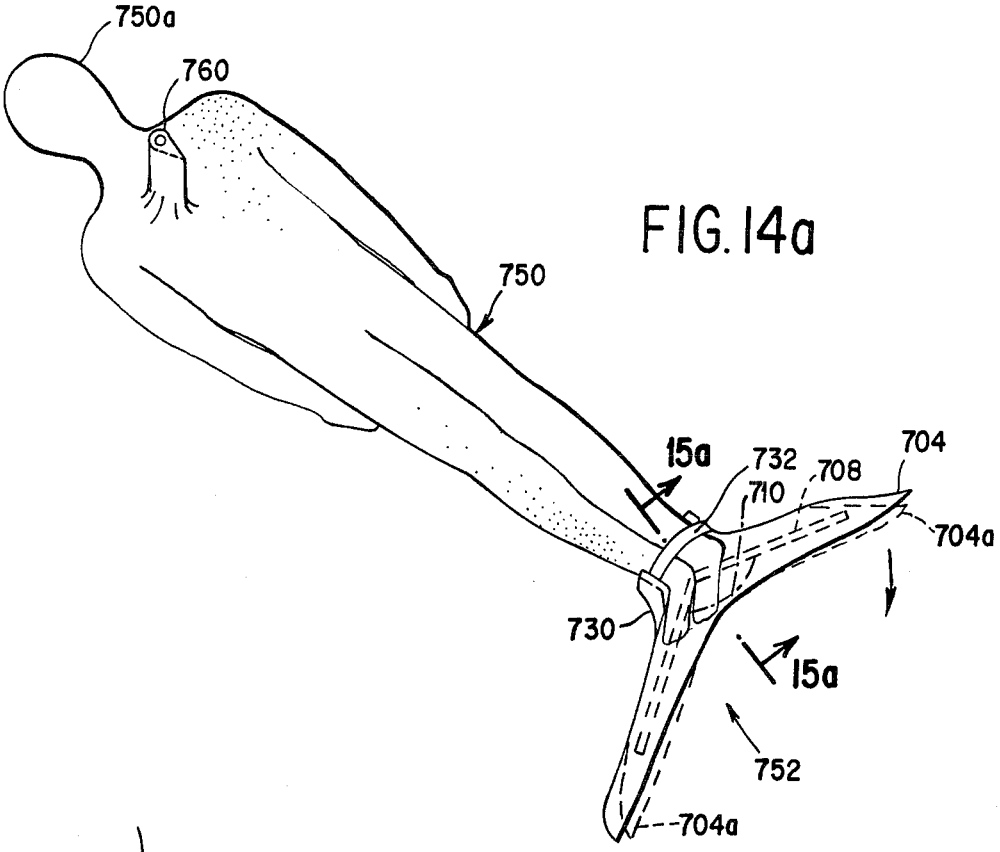
FIG. 14*a* is an overall view of the swimmer using the invention, showing the deflection of the swim fin of the invention on a downstroke.
Figure 14B:
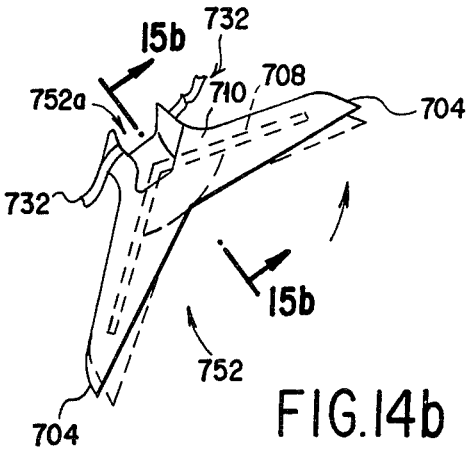
FIG. 14*b* shows the deflection of the fin on the upstroke.

FIGS. 14*a* and 14*b* illustrate operation of the improved wet-suit of the invention, comprising the improved swim fin of the invention as discussed in connection with FIG. 3. FIG. 14*a* shows a swimmer with his legs on a downstroke and illustrates the twisting of tips 704 of the tail fin about the rod member 708 shown in phantom, such that they are displaced upwardly from their normal position, which is shown in dotted lines at 704*a*, all as explained in connection with FIG. 3. FIG. 14*b* is comparable and shows how the tips of the swim fin 704 are displaced downwardly from their normal position, again shown in dotted lines, on the upward stroke, as indicated by the arrow.

In the embodiment shown, the swimmer's arms and hands are not faired, but this would be desirable as well for ultimate swimming efficiency.

Also shown in FIG. 14 is an integral snorkel 760, which is preferably streamlined in cross-section, for reduced water resistance, and which communicates via a tube formed in the wetsuit with a mouthpiece in the vicinity of the swimmer's mouth. As shown, in the preferred embodiment the integral snorkel 762 is relatively thick, e.g. 2–3 inches thick. In this embodiment it is envisioned that the snorkel 760 can also act as a hydrofoil, to provide a rudder effect much as does the dorsal fin of a dolphin or shark. For this purpose the snorkel might desirably be integrally formed with the head-containing helmet portion of the wetsuit 750. It will be understood that the principle of operation of the hydrofoil-section snorkel will be the same as the swim fin 700, i.e. that twisting it relative to the direction of motion of the swimmer will create lift, thus providing steering, and that this will occur whether the swimmer swims on his front (i.e. when underwater) or on his back (both on the surface and underwater).

In a preferred embodiment the fin blade 752 is attachable to and removable from the wetsuit 750, to permit wading, walking, etc., without the necessity of removing the wetsuit. Preferably the fin portion 752 is attached to the foot-receiving portions 730 of the wet suit, which are of the separably affixable design of FIG. 6, or its equivalent. In this way the fin portion 752 could be carried by a swimmer while walking or climbing while wearing the wetsuit of the invention; when he reached the water, the fin could be attached (by straps 732, interfitting male and female plug-and-socket members or the like) and the foot receiving portions affixed to one another, so as to create a unitary whole. The central portion of the fin could be formed with a cup-like recess member 752a as shown for receiving the ankles of the swimmer, to further insure rigidity. This cup-like recess member 752a could be formed integrally with the rod 708 and plate 710, of a stiff but light plastic material such as fiberglass or polyvinylchloride, while the fin portion would be much more pliant. Indeed the fin portion might desirably be of a skin-over-foam construction. A variety of differing fin shapes might be supplied as well for various swimming activities, e.g. leisurely reef exploration might call for different fin constructions than racing.

Figure 15A:
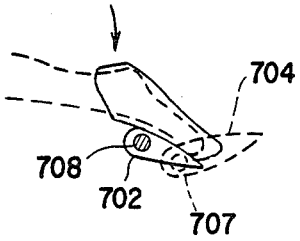
FIGS. 15*a* and 15*b* are cross-sectional views of the swim fin of the invention showing the deflection of the fin on the downstroke and upstroke, respectively.
Figure 15B:
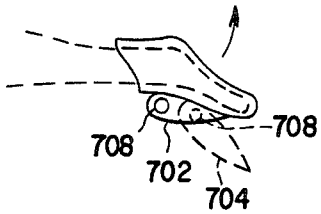

Finally, FIGS. 15*a* and 15*b* show cross-sectional views taken along the lines 15*a*–15*a* and 15*b*–15*b* of FIGS. 14*a* and 14*b*, respectively. In these figures, the center portion 702 of the streamlined swim fin of the invention is shown in full and the end portions are shown in dotted lines as at 704. The swept back fin structure causes the relative displacement of the central and tail tip portions shown.

Figure 16:
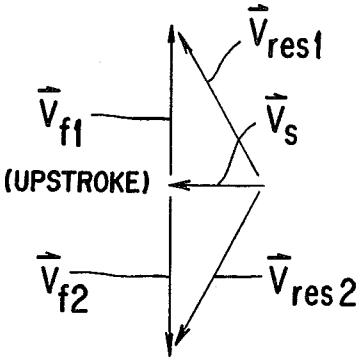
FIG. 16 shows a vector diagram explaining the relationship between the swimmer's speed and the instantaneous motion of the fin with respect to the water.
Figure 17:
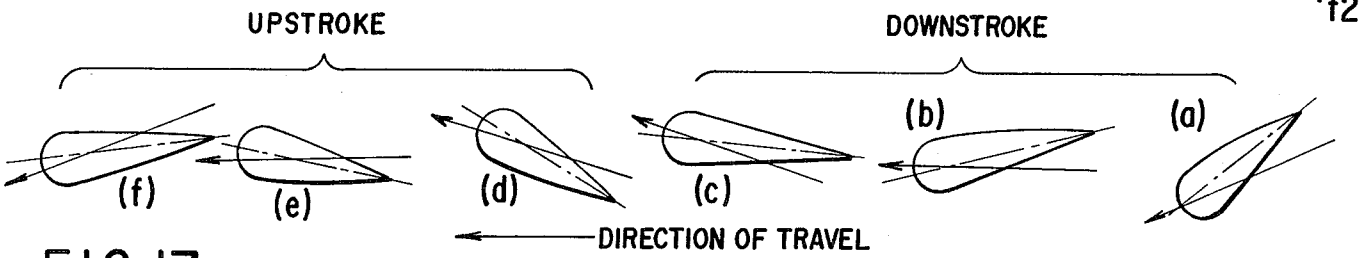
FIGS. 17*a* through 17*f* show the relationship of the chord line of a particular embodiment of the fin of the invention, with respect to the swimmer's direction of travel, at various points in the kicking motion.

FIGS. 16 through 18 describe an additional embodiment of the invention. In this case, the fin comprises a stiffening rib located towards the leading edge of the fin, a relatively resilient skin, and linkage members connecting the stiffening rod with the rear trailing edge of the fin. In this way the shape of the fin can be controlled to take two different asymmetrical cross-sectional shapes due to water pressure thereon during the upstroke and the downstroke. This permits the chord line of the fin to take essentially a zero angle of attack with respect to the flow of water thereover. This permits lift to be generated at very low drag, further improving the efficiency of swimming of the swimmer.

FIG. 16 shows a vector diagram explaining some of the terminology used hereinafter. At any given moment, the velocity of water flow over the fin is a vector sum of two vectors, one relating to the forward motion of the swimmer with respect to the water, and one relative to the arcing motion of the fin with respect to the horizontal. Typically the velocity of the arcing motion, caused by the swimmer's kicking, will be relatively greater than the forward velocity of the swimmer. This is illustrated in FIG. 16 in which $V_s$ represents the swimmer's forward velocity. Midway through the upstroke, for example, the swimmer's kicking imparts a vertical velocity exemplified by a vector $V_{f1}$. The sum of these vectors is the resultant velocity $V_{res1}$ of the fin at this instant of time. Similarly, at the midpoint of the downstroke, the fin velocity vector $V_{res2}$ is the sum of $V_{f2}$ and $V_s$.

Lift obtained using Bernouilli's principle, that is, by disposing a foil in a flowing medium, such that the medium flows more rapidly over one side of the foil than another, generating a lift perpendicular to the faster flowing medium, involves drag due to the viscosity of the medium. The ultimate performance of the foil will be limited by its lift/drag ratio. Drag is a function of numerous factors, particularly the angle of attack of the foil with respect to the medium, that is, the angle the chord line of the foil makes with respect to the vector describing the net velocity of the foil through the medium. If lift is obtained by disposing the foil at a high angle of attack with respect to the velocity vector, the foil will present a relatively large cross-sectional area to the medium, causing high drag. It would be preferable if significant lift could be provided at essentially zero angle of attack, so as to minimize drag. This requires that lift be provided by employment of an asymmetrical foil profile, such as is done in connection with airplane wings.

Optimization of the angle of attack to maximize the lift-drag ratio is particularly complicated in connection with the design of a foil to be driven by the kicking motion of a swimmer's feet, because the angle made by the foil with respect to the direction of motion of the swimmer varies during the kicking stroke. Moreover, use of the foil having an unvarying asymmetrical profile is not desirable in connection with a swimming aid, which must be kicked in opposite directions. An asymmetrical cross-section foil optimized for upward motion will not be optimum for generating lift on the downstroke.

According to this aspect of the invention, a fin is provided which varies between differing asymmetrical cross-sectional profiles depending on the direction in which it is kicked. This includes the twisting fins discussed above as well as the more positively controlled fins discussed below.

Furthermore, it is recognized that it is very unlikely that the optimal angle of attack will be identical across the breadth of a swim fin. Water flow at the center of the fin is very different than that near the tips due to the turbulence generated by the swimmer's body. Hence, the "deformability" characteristics of the fin, which allow its shape to be altered between two different asymmetrical shapes, should vary across its width. Further, difficulties in optimizing the "deformability" of the fin are caused by variation in water pressure at varying depths, the likelihood that the fin will be used for swimming at a variety of speeds, and so forth. It would be desirable for the fin to be operated at essentially zero angle of degree of attack throughout the kicking stroke. However, it is recognized that this will not necessarily always be the case. Therefore, the fin should also be designed to operate reasonably well at other angles of attack.

FIG. 17 shows the variation in angle of attack of a fin according to a further preferred embodiment of the invention, which is discussed in further detail below in connection with FIG. 18. Suffice it to say for purposes of discussing FIG. 17 that the surface of the fin is defined by a flexible skin, and that an internal linkage or other control means is provided to optimize variation in its cross-sectional shape as it is moved through the water. Specifically, the cross-sectional shape of the fin varies between differing asymmetrical shapes under the influence of water pressure thereon, so that lift can be generated with a minimum angle of attack, maximizing the lift/drag ratio.

FIG. 17 comprises FIG. 17*a* through 17*f*, which show the angle between the chord line of the fin according to the invention and the actual velocity to the water. These angles ideally would be zero, but as mentioned this is unlikely to be achieved; the angles shown are rather larger than would be desirable, for clarity. The variation in the shape of the cross-sectional foils shown is also somewhat exaggerated. FIG. 17*a* shows this relation at the end of the upstroke beginning of the downstroke; FIG. 17*b*, at the midpoint of the downstroke; FIG. 17*c*, intermediate the midpoint and end of the downstroke; FIG. 17*d*, at the end of the downstroke beginning of the upstroke; FIG. 17*e*, at the center of the upstroke; and FIG. 17*f*, intermediate the midpoint and end of the upstroke (FIG. 17*a*). In each case, the net velocity of the fin through the water is represented by the solid line with an arrowhead whereas the chord line of the fin is represented by the center line of the fin as shown.

During the downstroke as shown in FIGS. 17*a–c*, water pressure exerts a force on the underside of the fin. Its internal constuction causes its lower surface to flatten out, and its upper surface to belly somewhat. The resultant difference in path length creates a lift in the direction of the longer path, that is, generally forwardly. The fin takes a corresponding shape during the upstroke as shown in FIGS. 17*d–f*, again generating lift forwardly.

As mentioned, it would be ultimately desirable if the fin chord angle were aligned with the direction of the fin's net velocity through the water, to provide a zero angle of attack, but this is not likely to be achieved in practice and is not necessary to the functioning of the improved fin in this embodiment. As can be seen, it is anticipated that the chord angle of the fin will lag the actual velocity vector somewhat during motion of the fin through the water. As mentioned, in both FIGS. 17 and 18 the lag is somewhat exaggerated for clarity.

Figure 18B:
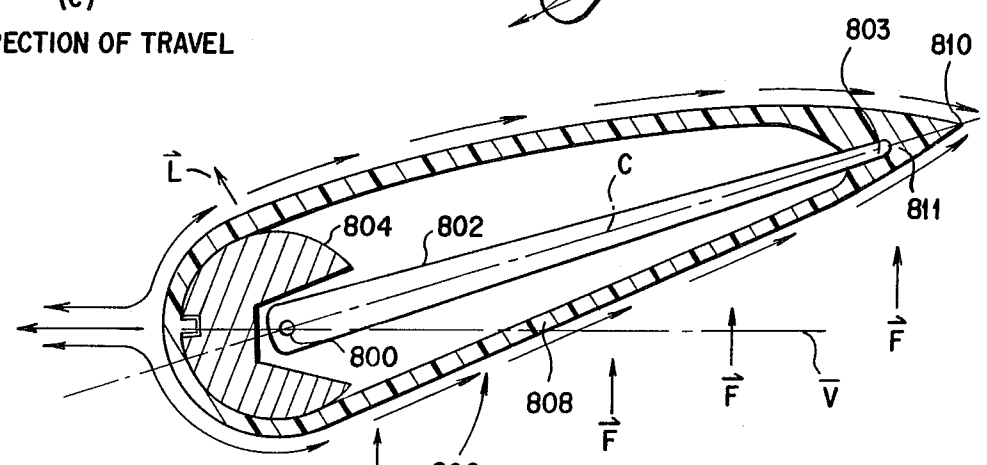
FIG. 18*a* and FIG. 18*b*, shows cross-sectional views of the fin of the invention in the embodiment of FIG. 17.
Figure 18A:
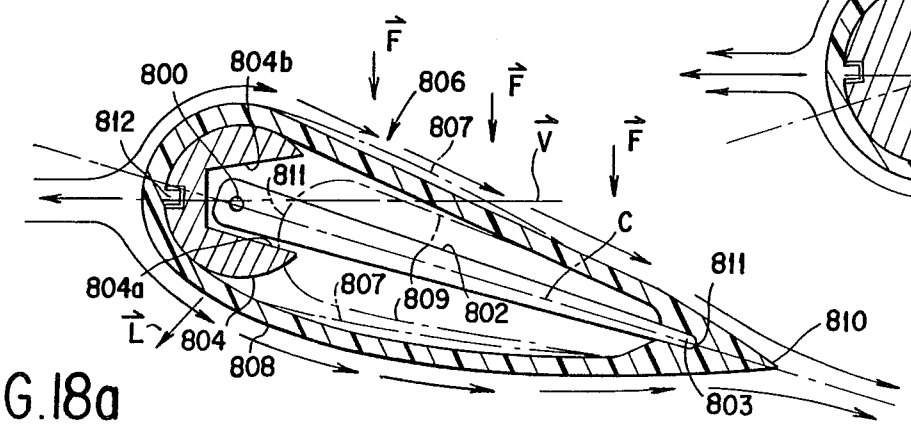

FIGS. 18*a* and 18*b* show cross-sectional views of a swim fin according to this embodiment of the invention. FIG. 18*a* shows the fin at the midpoint of the upstroke (corresponding to FIG. 17*e*). FIG. 18*b* shows the fin at the midpoint of the downstroke (corresponding to FIG. 17*b*). This is, FIGS. 18*a* and 18*b* show the configuration of the fin when the net velocity vector of the fin through the water is horizontal. Again, the effective chord line C of the fin as deformed is shown by a dashed line, while the actual velocity vector V of the fin through the water is shown by a solid line. These intersect at a pivot line 800, along or in the vicinity of which a number of linkage members 802 (only one being shown) are pivotally mounted to a stiffening rod member 804 located in the leading edge portion of the fin 806 according to this embodiment of the invention. Fin 806 is provided with a relatively tough outer skin 808 which terminates at a trailing edge 810. As shown, the trailing edge 810 may have a thickened cross-section region 811 to receive the trailing edge 803 of the linkage member 802.

As can be seen, when in the upstroke position of FIG. 18*a*, the force F of the water on the upper surface of the fin causes the fin to be deformed, effectively twisting about the stiffening rod 804, such that the chord line C is below the actual velocity vector V, as shown. Conversely, on the downstroke (FIG. 18*b*), the force F of the water on the lower side of the fin similarly causes the chord line C to be displaced above the velocity vector V. In each case, the skin deforms to take the shapes substantially as shown. That is, the surface of the fin against which the force F of water is exerted by the swimmer becomes relatively straight, whereas that on the "lee" side (that is, the lower side in FIG. 18*a* and the upper side in FIG. 18*b*) bellies out somewhat. This has the effect of lengthening the path of the water around the lee side such that lift L is created on that side, further urging the swimmer forward.

Note once again that the "lag" of the chord line with respect to the velocity vector is shown exaggerated for clarity. If, as is intended in practice, the lag is less, the difference in the water path length would be greater, which would increase the lift and reduce the drag simultaneously. Note that lift is created even at a zero angle of attack (i.e., when the chord line coincides with the fin velocity vector) due to the asymmetry of the lengths of the water flow paths over the upper and lower surfaces of the fin.

The deformation of the fin on alternate up and down strokes between the two different asymmetrical shapes shown can be achieved in a number of ways. In either case, the fin should be symmetrical when unstressed, that is, at rest. The skin may be formed by injection molding of a relatively stiff plastic to provide the desired variation. For example, the upper and lower surfaces can be molded to have a slight bulge. When water pressure is exerted on one side, it will flatten somewhat; simultaneously the other side will bulge. In this way differing flow path lengths will effectively be provided. The natural resilience of the molded skin will return the fin to its unstressed position when the force ceases. The thickness of the skin can also be varied, both parallel to the chord line (as indicated in phantom at 807) and transversely, to define the manner in which the foil shape is varied.

In FIGS. 18*a* and 18*b*, it should be understood that the stiffener member 804 is relatively rigidly attached to the swimmer's feet, as discussed in connection with, for example, FIGS. 14 and 15. However, in this case, the lift is not generated simply by variation of the fin's angle of attack, but by actual changes in the fin's cross-sectional shape controlled by the linkage members 802, responsive to the force exerted thereon by motion through the water. It is believed that in this manner the fin's cross-sectional shape may be optimized with respect to the lift/drag ratio, further providing efficiencies in swimming for a swimmer. As indicated, the skin 808 may be affixed to the stiffening rod member 804 by a key means or the like shown schematically at 812; obviously this connection can take any desired form, and might simply be glued. Alternatively, the skin need not necessarily be affixed to the stiffening rod 804 but may move therearound, as described in connection with certain other embodiments of this invention. In such case, the linkage would again serve to control the relative shapes of the upper and lower surfaces as the swimmer moves the fin through the water.

The configuration of the fin in the other stages of FIG. 17, that is, when the velocity vector of the fin with respect to the water is not horizontal, will be essentially similar to the configurations shown in FIGS. 18*a* and 18*b*. Again, the chord line C of the fin may lag the velocity vector V somewhat. It should again be noted that FIGS. 17 and 18 exaggerate the angle between the chord line C and the velocity vector V; in practice, relatively subtle departures would be sought, to reduce drag by reducing the angle of attack.

Finally, as can be noted from FIGS. 18*a* and 18*b*, the stiffener rod member 804 may be formed to comprise stop means 804*a* and 804*b* limiting the angular excursion of the linkage members 802. A plurality of linkage members 802 may be disposed in the fin; for example, in connection with a fin 36" wide overall, 6 stiffener members at intervals of 6" across the width of the fin would probably be sufficient. It should also be recognized that the degree to which the chord angle departs from the actual velocity vector typically may vary across the fin. For example, the central section may be made relatively stiff by control of the thickness of the skin, the degree of motion permitted to the innermost linkage members 802 by the stop members 804*a* and 804*b*, and so on. It will also be noted that the fin should have a net density near that of water, for neutral buoyancy. This may be obtained by allowing water to fill the hollow center section of the fin, if the materials used are of generally neutral buoyancy. Otherwise, it may be desirable to seal the fin and provide some small amont of ballast to ensure relatively neutral buoyancy.

It is envisioned that all the elements of the swim fin having the internal linkage shown in FIGS. 18*a* and 18*b* will be formed of materials resistant to corrosion in sea water, and which are relatively strong and lightweight. For example, fiber reinforced plastics could be used for the stiffener rod member 804 and the linkage members 802. The skin could be made of a wide variety of strong, flexible plastic such as nylon, ABS, polycarbonate, or the like. The sole metallic material might be used for pivot pins defining pivot line 800, although these could be formed with plastics as well if designed correctly.

The material of the skin would also vary according to the details of its design. For example, if it were desired to mold the skin, the choice of its material would be different than if it were designed to be fabricated of sheetlike material, for example, of elastomeric character.

The use of the stiffener rod 804 and the links 802 is but one possible way of manufacturing a fin which is deformed predictably between differing asymmetrical shapes due to water pressure thereon. It appears entirely possible that the entire fin could be molded, perhaps in upper and lower unitary portions, avoiding the stiffener rod in favor of molded-in transverse stiffening braces (as shown in phantom at 811), and the links in favor of internal ribs molded integrally with the skin (as shown in phantom at 809), controlling deformation of the skin responsive to water pressure thereon. Similarly, the foot-receiving means employed could be molded integrally with the fin.

Obviously, numerous modifications and variations of the present invention are possible in light of the above teachings. It is therefore to be understood that within the scope of the appended claims, the invention may be practiced otherwise than as specifically described herein.

What is claimed is:

1. A swimming aid to be worn by a swimmer, comprising:

feet receiving means for securely receiving a swimmer's feet is spaced-apart, side-by-side relation;

fin means fixed to and extending outwardly from the feet receiving means, said fin means comprising a relatively flexible main wing-like portion with a substantially symmetrical tear-drop-shaped cross-section through the cord line of said fin means, having a rounded portion defining the leading edge portion of said fin means and a tapered portion defining the trailing edge portion of said fin means; and elongated relatively rigid stiffener means located in an elongated cavity in said relatively flexible main wing-like portion, extending outwardly from the center of said fin means, and including a rod-like member located in said cavity and extending substantially parallel to the leading edge of said fin means, said rod-like member being disposed loosely in said cavity to permit rotation of said fin means about said rod-like member, and a plate-like portion located in the central portion of said fin means and extending from said rod-like member rearwardly toward the trailing edge portion of said fin means, to inhibit twisting of the central portion of said fin means, said cavity being located closer to the leading edge portion than to the trailing edge portion, to permit a twist to be induced in the relatively flexible portion of said fin means under varying load conditions to thereby adjust the angle of attack of the said fin means.

2. A swimming aid according to claim 1, further comprising:

a left half-wing portion and a right half-wing portion, said left half-wing portion and said right half-wing portion being fixed to and extending outwardly from said fin means, said half-wing portions together defining a wing-like shape, the side-to-side length being substantially greater than the front-to-back extent of said fin means to provide a fin means having an aspect ratio greater than about 5.

3. A swimming aid according to claim 2, wherein the aspect ratio is at least about 10.

4. A swimming aid according to claim 2, wherein said wing-like portions extend substantially perpendicularly from the respective sides of said feet receiving means.

5. A swimming aid according to claim 2, wherein the wing-like portions extend outwardly from the sides of the feet receiving means in a swept back configuration.

6. A swimming aid to be worn by a swimmer, comprising a pair of cavities for receiving the feet of a swimmer in side-by-side, spaced parallel relationship, and a resilient fin portion extending outwardly from said foot-receiving means in either direction transverse to the direction of travel of the swimmer, said fin portion having a dimension in said direction transverse to the travel of the swimmer at least five times as great as its dimensions parallel to the direction of travel of the swimmer, said resilient fin portion having a generally teardrop shape in cross-section so as to define a rounding leading edge and relatively sharpened trailing edge, said swimming aid further comprising means for stiffening said fin in a direction transverse to the direction of motion of the swimmer, said resilient fin portion being attached to said stiffening means by means permitting relative motion thereof and being formed of a material of sufficient resiliency that the outermost tips of said resilient fin portion are permitted to rotate through an angle of approximately 90 degrees relative to such stiffening member, under the influence of water pressure exerted by a swimmer in performing a swimming stroke.

7. A swimming aid according to claim 6, wherein said outermost tips of said resilient member are generally swept back from said pair of cavities for receiving the feet of the swimmer.

8. A swimming aid comprising a generally elongated swim fin, having a substantially uniform teardrop-shaped transverse cross-section so as to define a rounded leading edge and a relatively sharpened trailing edge, said fin having means for receiving the feet of a swimmer in spaced parallel relationship at substantially the center thereof, said fin being formed of a resilient member and having a stiffening member therein, said resilient material closely engaging said stiffening member at the center portion thereof in juxtaposition to the means for receiving the feet of the swimmer, such that the central portion of said fin does not twist substantially about its transverse axis in swimming, said stiffening member comprising an elongated portion generally disposed within said leading edge of said fin, the resilient portion of said swim fin being adapted to pivot about said elongated portion of said stiffening member, whereby the tips of said fin twist substantially upon exertion of force thereon by water in performance of swimming by a swimmer, and the portions of said fin intermediate said tips and said central portion twist a lesser amount than said tips.

9. A swimming aid according to claim 8, wherein the resiliency of said resilient material is such that the amount of twisting of said tips of said swim fin upon exertion of the force thereon by a swimmer is substantially greater than the amount of angular motion undergone by the ankles of said swimmer.

10. A swim fin, comprising:

a hydrofoil portion and a foot attachment portion, said foot attachment portion comprising means for affixing said hydrofoil portion to the feet of a swimmer in predetermined relation thereto, wherein said hydrofoil portion extends transversely from both sides of said foot attachment portion, and wherein the cross sectional shape of said hydrofoil portion is varied between differing asymmetrical shapes upon exertion of water pressure thereon, said hydrofoil portion comprising a substantially rigid stiffener member fixedly attached to said foot attachment portion, a flexible skin over said foot attachment portion and said stiffener member, said skin having a cross-sectional shape having a first relatively rounded leading edge portion and a second relatively sharpened trailing edge portion, said stiffener member being disposed generally within said rounded leading edge of said skin, and a plurality of links each pivotally connected at a first end to said stiffener member and at a second end generally to said trailing edge portion.

11. A swim fin according to claim 10, wherein said skin is molded of a plastic material.

12. A swim fin according to claim 11, wherein the thickness of said skin varies along the cross-section of said fin to provide an optimal cross-sectional shape in swimming therewith.

13. A swim fin according to claim 10, wherein said skin is formed of a relatively extensible elastomeric material.

14. A swim fin, comprising a foot receiving portion that is molded of a plastic material, and a hydrofoil portion that is molded of a plastic material, said hydrofoil portion being molded integrally with said foot receiving portion so as to extend transversely from either side thereof, said hydrofoil portion having a cross-sectional shape having a generally rounded leading edge and a generally sharpened trailing edge, said hydrofoil comprising a skin, internal transverse stiffener means and internal motion-controlling means, wherein said motion-controlling means allows said skin to take differing asymmetrical cross-sectional configurations responsive to water pressure on upper and lower surfaces thereof.

15. A swim fin according to claim 14, wherein said internal transverse stiffening means comprises stiffener members molded integrally with said skin.

16. A swim fin according to claim 14, wherein said motion-controlling means comprises stiffener members molded integrally with said skin.

* * * * *